United States Patent [19]

Moreau

[11] Patent Number: 4,622,768

[45] Date of Patent: Nov. 18, 1986

[54] REVERSIBLE AND ADVERTISING GREETING CARD

[76] Inventor: Claude R. M. Moreau, 85-06 60th Ave., Elmhurst, N.Y. 11373

[21] Appl. No.: 705,509

[22] Filed: Feb. 25, 1985

[51] Int. Cl.[4] ..... B42D 15/02

[52] U.S. Cl. ..... 40/124.1; 229/92.8

[58] Field of Search ..... 40/124.1; 229/92.8; 428/40, 13, 9, 124, 187, 542.2; 206/232

[56] References Cited

U.S. PATENT DOCUMENTS

| | | | |
|---|---|---|---|
| 1,058,357 | 4/1913 | Fawkes | 229/92.8 X |
| 2,111,520 | 3/1938 | White | 40/124.1 |
| 3,141,549 | 7/1964 | Koehler | 206/232 |
| 4,200,222 | 4/1980 | Feuer | 428/40 X |
| 4,270,291 | 6/1981 | Babberl | 40/610 X |
| 4,380,128 | 4/1983 | Ichikawa | 428/542.2 X |
| 4,428,526 | 1/1984 | Riley | 229/92.8 |
| 4,440,298 | 4/1984 | Knight | 206/457 X |
| 4,487,431 | 12/1984 | Kelly | 206/232 X |
| 4,541,190 | 9/1985 | Weiner | 40/124.1 X |

FOREIGN PATENT DOCUMENTS

| | | | |
|---|---|---|---|
| 2086116 | 5/1982 | United Kingdom | 428/9 |

*Primary Examiner*—Henry F. Epstein

[57] ABSTRACT

Reversible multifoldable greeting and advertising card having a plurality of panels with illustrations thereon and off-set openings in the panels through which the illustrations are visible to display messages and greetings to be conveyed which are related to various occasions and circumstances.

1 Claim, 5 Drawing Figures

FIG. 1
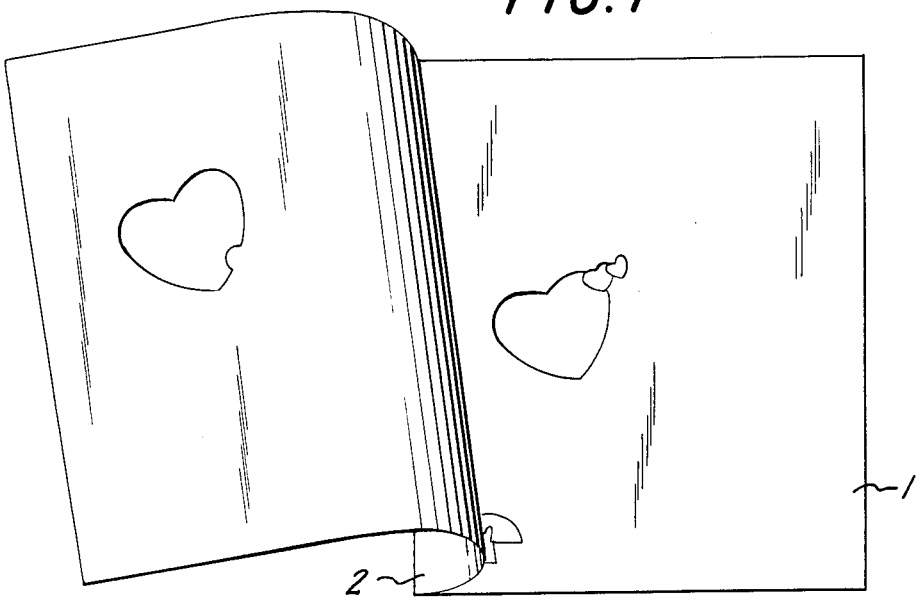
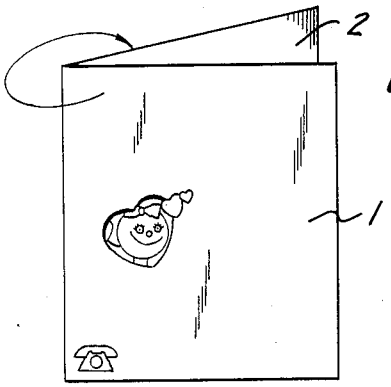
FIG. 2
FIG. 4
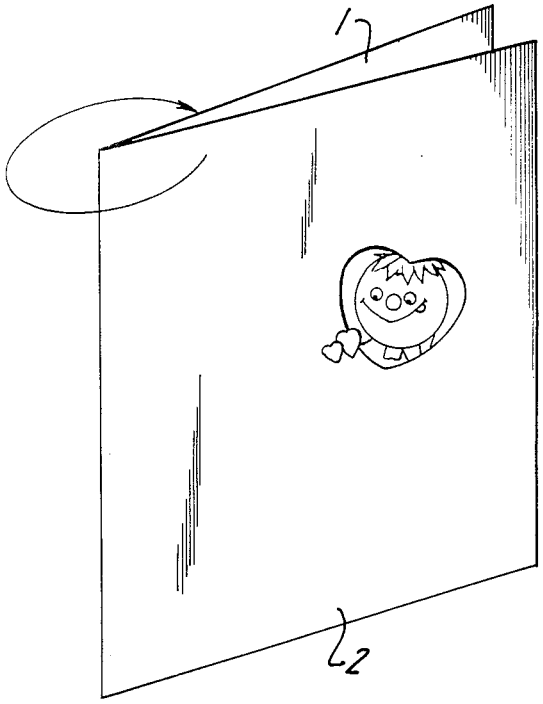
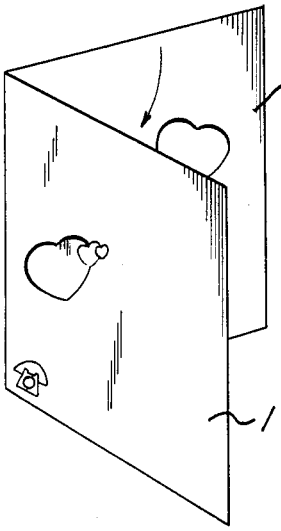
FIG. 3

REVERSIBLE AND ADVERTISING GREETING CARD

The present invention relates to a multifunctional greeting card having a plurality of panels, having at least two panels foldable about a common foldline, with illustrations and/or legends thereon and window-openings therein, for example heart-shaped, judiciously positioned to correspond to a particular area of the printed subject matter on a lower panel such as the head of a character or a message or appropriate logo or design which is complementary in appearance and meaning to the message illustrated on an upper panel, such as thoughts about a loved one. The upper panel becomes a lower panel when the card is folded to display or expose a lower panel. The above folding and reversing of the panels can be repeated at will to show each panel alternatively or consecutively.

BRIEF DESCRIPTION OF THE DRAWINGS

FIG. 1 shows a reversible greeting and advertising card according to the invention with one panel partially folded back from the underlying panel.

FIG. 2 is a vertical face view of the card of FIG. 1 partially in perspective with the panels disposed at an acute angle to one another and having a heart-shaped opening in one panel through which a particular area of an illustration can be seen on the other panel thereof.

FIG. 3 is a view similar to FIG. 2 with the panels open at a wider angle to show a window in each panel and the relative positions to one another in their respective panels.

FIG. 4 is a view of a card similar to FIG. 2 when the panels are reversed.

Figure 5:
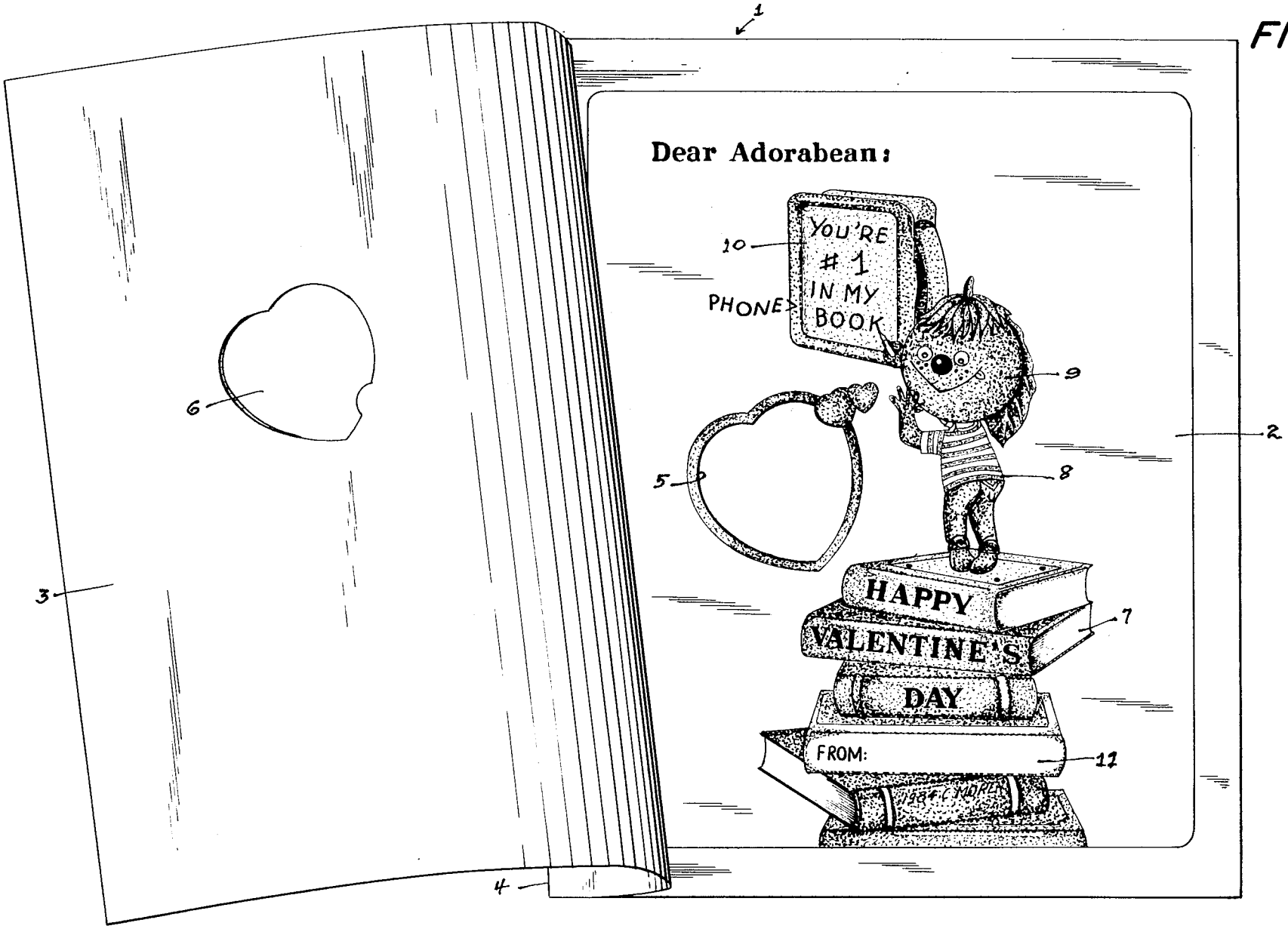
FIG. 5 is a view similar to FIG. 1 of a card of the invention on a larger scale and illustrating one typical exemplification of design and/or messages.

In accordance with the present invention I have provided a reversible greeting and advertising card which, by way of example, comprises two panels 1 and 2 which can be folded and reversed at will where the panels are joined about a fold line for expressing or conveying different thoughts and messages for a variety of occasions and/or for advertising purposes to which the card may be put as well. The illustrated panels of the reversible foldable card are provided with heart-shaped openings so arranged that they do not coincide when the panels of the card are folded, and while the openings of this Valentine's Day card are heart-shaped to connote the occasion, they may also be of any other specific configurations desired, not to be limited to any specific kind or type of shape.

As will be seen from FIGS. 2 to 4, the card has two panels 1 and 2 each with a heart-shaped opening which shows therethrough the head of a character illustrated on the underlying panel. The illustration, wherein the panels may be of different or complementary colors according to the subject matter, may also incorporate a manufacturer's products as integral with the subject matter for advertising purposes or explaining or emphasizing their properties or qualities. A logo is shown partly or entirely in FIGS. 1 to 3 for the purpose of identifying the manufacturer/advertiser.

The reversible, foldable card can also be multifoldable to display and advertise products as an integral part of an illustrated story, with a manufacturer's logo appropriately displayed on at least one card panel as shown.

The exemplification shown in FIG. 5 is illustrative of my novel inventive concept and applicable to a particular occasion.

It will therefore be seen that in effect I have provided a multi-panel novel, reversible, multifunctional, versatile greeting and/or advertising and/or other card in a message-conveying form which is adaptable to a great variety of occasions. By means of a single reversible card, the effect of two or more different cards can be obtained and displayed accordingly. The messages or sentiments to be conveyed are many and varied and when desired a manufacturer's or advertiser's products and trademark are included as a part of the illustrations thereon. The card and its message and/or illustrations may have the effect of a mini-catalog or mail order or promotional article.

The invention also includes calendars and cards with multiple folds and reversibility for a variety of purposes as will be appreciated so that the foregoing is intended as exemplary and non-limitative as defined by the subjoined claims.

What I claim is:

1. A two-in-one reversible card suitable for greetings and a variety of other occasions and circumstances, bearing a number of interacting, complementary or unrelated exhibits which can be dislayed at will through alternate selections, according to the user's choice, comprising:

a single sheet of material defining first and second sheet-like panels;

said first sheet-like panel bearing thereon first printed matter and having a first cutout opening defined in said panel;

said second sheet-like panel bearing thereon second printed matter and having a second cutout opening defined in said second panel;

said sheet of material including a fold line separating said first and second panels for relative movement of said panels about said fold line between a first position in which said first panel substantially flatly overlies said second panel and a second position in which said second panel substantially flatly overlies said first panel; and said first and second cutout openings being defined in said first and second panels in relatively offset and non-overlapping relation, and said first and second printed matter being disposed on said first and second panels, so that at least a portion of said second printed matter is aligned with and visible through said first cutout opening in said first position of said panels for conveying a composite message or idea or illustration formed by combining said first printed matter and said portion of said second printed matter to thereby convey a first idea or message and thereby provide a first function of said card, and so that at least a portion of said first printed matter is aligned with and visible through said second cutout opening in said second position of said panels for conveying a composite message or idea or illustration formed by combining said second printed matter and said portion of said first printed matter to thereby convey a second idea or message and thereby provide a second function for said card, such that said card provides a choice of selection to the user and a choice of display to the seller.

* * * * *